US006386284B1

(12) United States Patent
Buck et al.

(10) Patent No.: US 6,386,284 B1
(45) Date of Patent: May 14, 2002

(54) SNUBBING UNIT DRILLING SYSTEM

(76) Inventors: David A. Buck, 1348 Sawmill Hwy., Breaux Bridge, LA (US) 70517; Daniel S. Bangert, 156 Beau Coteau Pkwy., Broussard, LA (US) 70518

( * ) Notice: Subject to any disclaimer, the term of this patent is extended or adjusted under 35 U.S.C. 154(b) by 0 days.

(21) Appl. No.: 09/503,129

(22) Filed: Feb. 11, 2000

(51) Int. Cl.[7] ..... E12B 19/18

(52) U.S. Cl. ..... 166/77.53; 166/380; 166/78.1; 166/85.1

(58) Field of Search ..... 166/77.51, 77.1, 166/77.53, 78.1, 85.1, 85.5, 380; 173/149, 164

(56) References Cited

U.S. PATENT DOCUMENTS

| | | | | |
|---|---|---|---|---|
| 1,811,666 A | | 6/1931 | Foster | |
| 3,799,009 A | * | 3/1974 | Guier | 81/57.16 |
| 4,085,796 A | | 4/1978 | Council | 166/77.5 |
| 4,147,215 A | * | 4/1979 | Hodge et al. | 166/380 |
| 4,269,277 A | | 5/1981 | Baugh | 173/149 |
| 4,567,952 A | * | 2/1986 | Lemaire et al. | 173/164 |
| 4,974,686 A | * | 12/1990 | Hisey et al. | 173/164 |
| 5,664,310 A | * | 9/1997 | Penisson | 29/407.2 |
| 5,746,276 A | | 5/1998 | Stuart | |
| 6,158,516 A | * | 12/2000 | Smith et al. | 166/385 |
| 6,213,216 B1 | * | 4/2001 | Rodgers | 166/380 |

FOREIGN PATENT DOCUMENTS

| | | | |
|---|---|---|---|
| WO | WO-00/52298 | * | 9/2000 |

* cited by examiner

*Primary Examiner*—David Bagnell
*Assistant Examiner*—Jennifer R. Dougherty
(74) *Attorney, Agent, or Firm*—Jesse D. Lambert

(57) ABSTRACT

A snubbing unit drilling system which includes a power tong and a hydraulically activated back-up tong. A mounting structure having a rotating slip assembly positioned thereon such that the rotating slip assembly rotates relative to the mounting structure. A plurality of support legs are attached between the power tong, the back-up tong, and the mounting structure such that the support legs prevent relative rotation between the power tong and the mounting structure.

25 Claims, 5 Drawing Sheets

SNUBBING UNIT DRILLING SYSTEM

FIELD OF THE INVENTION

The present invention relates to equipment and techniques for performing workover or snubbing operations commonly carried out in the oil and gas recovery industry. In particular, the present invention relates to an improved snubbing unit which allows tubular members to be run and rotated more efficiently than hereto known in the art.

BACKGROUND OF THE INVENTION

In oil and gas recovery operations, tubular members are usually run or pulled using a workover rig or a snubbing unit. Workover rigs are in essence small drilling rigs having a derrick and draw works. While workover rigs are less expensive and time consuming to employ than full sized drilling rigs, use of workover rigs can still be quite costly. Snubbing units are smaller, easier to transport and less expensive to operate than workover rigs. Moreover, snubbing units are often employed when working a pressurized well which requires the tubular members be forced into the well bore. A snubbing unit typically consists of a raised platform with two or more slip assemblies positioned beneath the platform. A typical prior snubbing unit is disclosed in U.S. Pat. No. 4,085,796 to Council. Often the raised platform of the snubbing unit will include a railed work area or "basket" such as seen in U.S. Pat. No. 4,085,796. The two or more slip assemblies will be operated to run or pull tubulars as is well known in the art. Workmen will occupy the basket to assist in running or pulling the tubulars and will normally employ a power tong and a back-up tong in the basket to makeup or break apart a string of tubulars.

It is often desirable during snubbing operations to rotate the tubular member. While units such as in U.S. Pat. No. 4,085,796 do not provide a method for applying torque to the tubular, other snubbing units such as that seen in U.S. Pat. No. 5,746,276 to Stuart do. U.S. Pat. No. 5,746,276 shows the typical snubbing unit having an upright structure with two slip assemblies positioned within the structure and a back-up tong positioned atop the structure. However, the entire structure is further positioned upon a rotary table. When it is desired to rotate the tubular member, the tong grips the tubular member and the entire structure spins on the rotary table. It will be understood that the snubbing units as shown in the above patents must additionally utilize a power tong and back-up tong combination to makeup and break apart joints on the string of tubulars being run. Most commonly, the power tong and back-up combination will be suspended from a cable and hang in inside the basket such as to be accessible by workmen. Alternatively, the power tong and back-up tong combination could connected to the structure of the snubbing unit itself. However, when tongs are connected to the rotary table such as suggested in Stuart, the power tong and back-up tong combination must rotate within the basket.

There are serious disadvantages in the manner which the prior art snubbing units apply torque to the tubular. First, while many snubbing units may incorporate a rotary table, often these snubbing units do not have a back-up tong gripping the tubular as seen in Stuart. Rather, the snubbing unit relies on the gripping force of the slips in order to transfer torque from the rotary table to the tubular. However, slips are primarily designed to hold the tubular against vertical movement and may not securely hold the tubular against rotary movement. Therefore, applying torque with slips often results in slippage between the tubular and the slips, causing serious and damaging scaring of the tubular surface.

Second, it is inherently inefficient to utilize two torque producing tools in a single snubbing unit. Existing snubbing units use a rotary table to apply torque to the entire drill string, but also must use a power tong to apply torque to a tubular joint being made-up or broken apart. It would be a more efficient system to use a single torque source, either the rotary table or the power tong, to perform both tasks. A single torque source would reduce the cost, weight, and overall size of the snubbing unit.

Third, rotating the entire slip assembly and tongs attached thereto creates a hazardous work environment. The workmen in the basket must have access to the power and back-up tongs when they are not rotating. However, if the tongs are rotating in conjunction with the slips and tubular string, the tongs could seriously injure a workman who inadvertently places a limb in the circumference of the rotating tongs. The snubbing unit's basket would be a far safer work environment if the power and back-up tongs did not rotate when torque is applied to the tubular string.

OBJECTS AND SUMMARY OF THE INVENTION

It is therefore an object of the present invention to provide a snubbing unit which may apply torque to a tubular string without scarring or otherwise damaging the tubulars.

It is another object of the present invention to provide a snubbing unit which may apply torque to the tubular string and makeup/break apart tubulars using the same torque source.

It is still another object of the present invention to provide a safer snubbing unit by eliminating the necessity of rotating the power and back-up tongs when applying torque to the tubular string.

Therefore the present invention provides a snubbing unit drilling system which will include a power tong, a back-up tong, and a mounting structure having a rotating slip assembly positioned on the mounting structure, such that the rotating slip assembly may rotate relative to the mounting structure. A plurality of support legs will be attached between the power tong and the mounting structure such that the support legs prevent relative rotation between the power tong and the mounting structure.

DETAIL DESCRIPTION OF THE INVENTION

Figure 1:
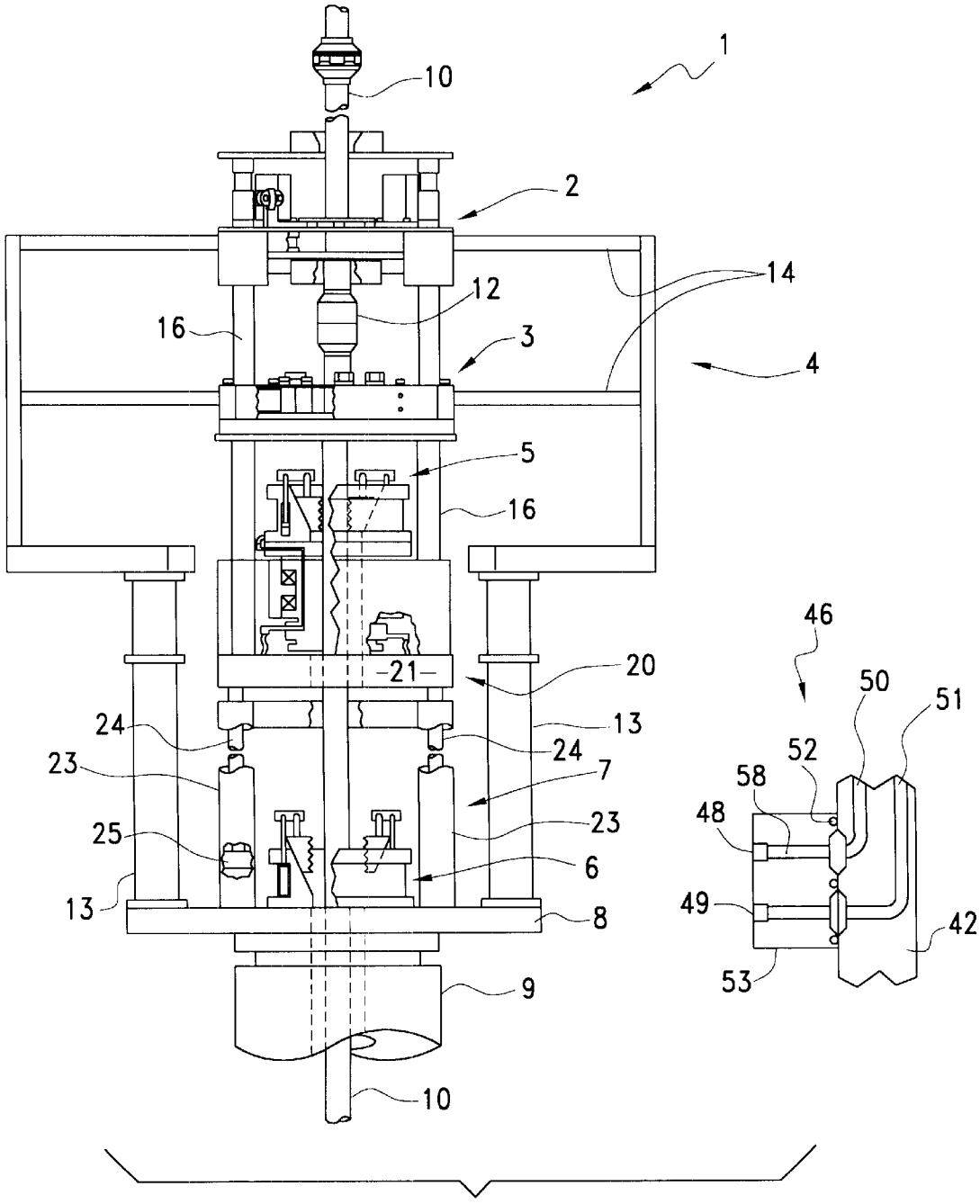
FIG. 1 is a side view of the improved snubbing unit of the present invention.

FIG. 1 illustrates one embodiment of the present invention, a snubbing unit drilling system, henceforth referred to more briefly as snubbing unit 1. It is noted that FIG. 1 provides partial cutaway views of various elements forming snubbing unit 1. Snubbing unit 1 will generally comprise a base plate 8 with basket support columns 13 extending upward therefrom and supporting work basket 4. The front section of basket 4, including the front sections of railing 14 are shown removed in order to more clearly illustrate the important elements of snubbing unit 1. As can be seen, power tong 2 and back-up tong 3 are positioned at a level where workmen in basket 4 may access these tongs. Power tong 2 and back-up tong 3 operate together to make-up or break apart the joints 12 connecting individual tubular members in tubular string 10. Below back-up tong 3 is rotating slip assembly 5 which will be explained in greater detail below. Rotating slip assembly 5 will rest on a mounting structure 20 which in the embodiment shown is a mounting plate 21. Support legs 16 rest on mounting plate 21 and extend upward to support both back-up tong 3 and power tong 2. While only two support legs 16 are seen in FIG. 1, it will be understood that this embodiment of snubbing unit 1 will have four support legs 16, positioned roughly in a square orientation. Thus, support legs 16 will engage and stabilize the four corners of back-up tong 3 and power tong 2. The manner in which support legs 16 engage back-up tong 3 and power tong 2 is more fully described in U.S. patent application Ser. No. 09/349,292 to Daniel Bangert filed on Jul. 8, 1999, the entirety of which is incorporated by reference herein. For purposes of describing the present invention, the main point is that support legs 16 fix back-up tong 3 and power tong 2 to mounting plate 21 and prevent any relative rotation between these structures.

Snubbing unit 1 further generally comprises a lifting assembly 7 mounted upon base plate 8. In the embodiment shown, lifting assembly 7 includes four hydraulic cylinders 23 (although only two hydraulic cylinders 23 can be seen in the view of FIG. 1). Hydraulic cylinders 23 can be any conventional hydraulic piston and cylinder assembly and normally will have hydraulic rams 24 with piston heads 25. Hoses and other details concerning the flow of hydraulic fluid in cylinders 23 are not shown since the operation of hydraulic cylinders is so well known in the art. Moreover, many other types of conventional lift assemblies could be used in place of hydraulic cylinders 23 and these are intended to be included within the scope of the invention. Further, while the cylinder and piston assemblies will generally be discussed herein as being hydraulically operated, it will be understood compressed air cylinder and piston assemblies could also be employed. Also positioned upon base plate 8 is fixed slip assembly 6. Slip assembly 6 is fixed in the sense that it cannot rotate relative to base plate 8. In FIG. 1, the base plate is shown positioned upon blow-out preventer 9. Blow-out preventer 9, which typically exists on a well being worked over, is commonly the structure upon which a snubbing unit rests. Blow-out preventer 9 does not form part of the present invention.

The lift cycle in which snubbing unit 1 moves tubular string 10 in the vertical direction is not significantly different than that of the prior art. The lift cycle begins with hydraulic cylinders 23 having rams 24 retracted within the cylinders. Thus, mounting plate 21 is in its lowered position along with rotating slip assembly 5. Fixed lower slip assembly 6 is then released (as seen in FIG. 1) and rams 24 are extended by the application of hydraulic fluid to cylinders 23 as is typical in the art. Because the slips in rotating slip assembly 5 are engaging tubular string 10, the lifting of mounting plate 21 and rotating slip assembly 5 by hydraulic cylinders 23 will raise tubular string 10. When rams 23 reach their maximum travel, fixed slip assembly 6 will re-engage tubular string 10 and hold tubular string 10 at its present vertical position while the slips in rotating slip assembly 5 are released. Rams 24 may again be retracted into cylinders 23, lowering rotating slip assembly 5 into position to begin another lift cycle.

Figure 2:
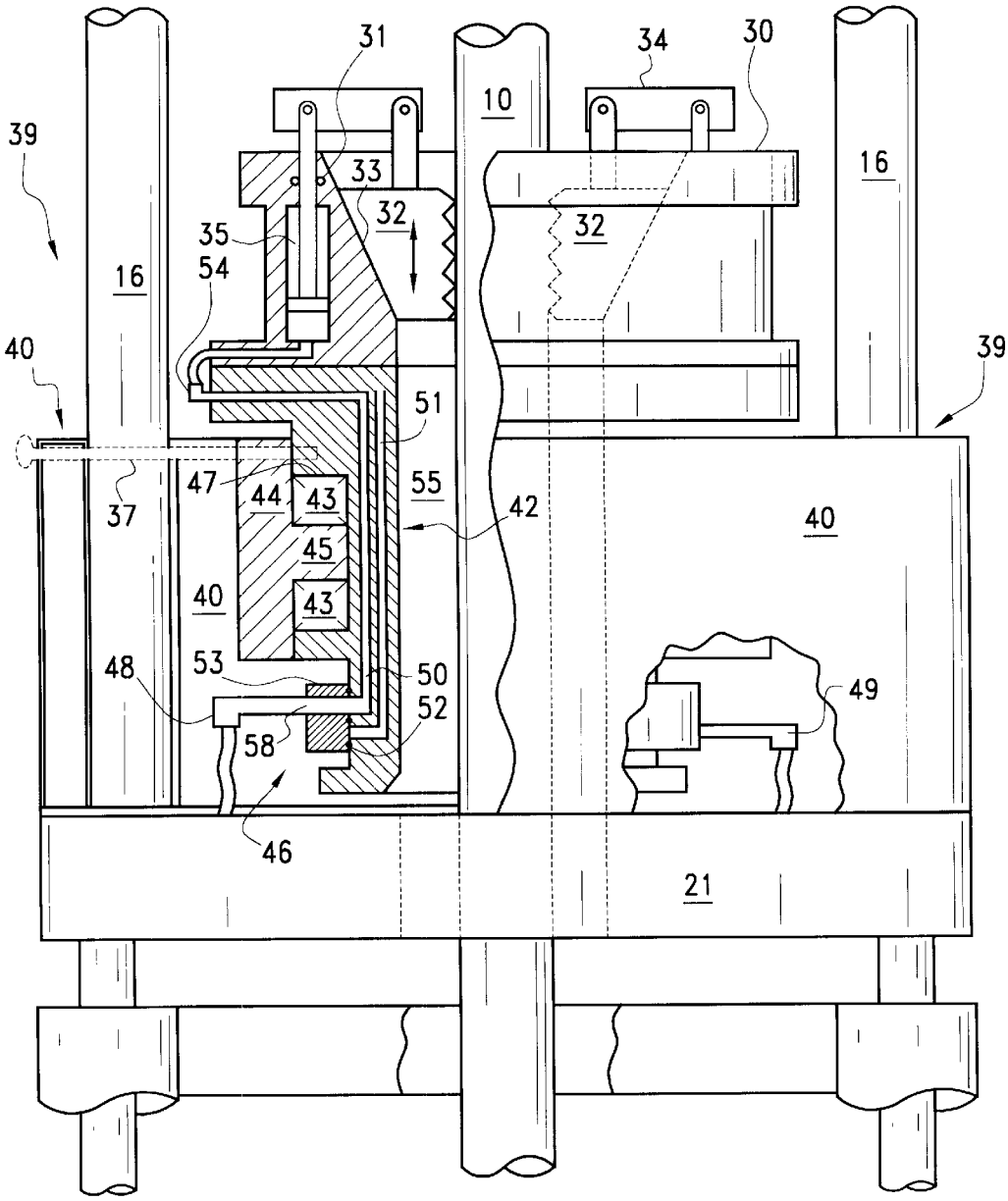
FIG. 2 is an enlarged view of the freely rotating slip assembly of the present invention.

Referring to FIG. 2, as is well known in the art, the slip assemblies will each comprise an annular slip bowl 30 having an incline surface 31. A plurality of slip jaws 32 will have a complementary inclined surface 33 which slides down surface 31 allowing teeth on slip jaws 32 to engage tubular string 10. When slip jaws 32 are set (i.e. placed against tubular string 10), it will be readily apparent that the weight of tubular string 10 pulling slip jaw 32 downward will cause slip jaw 32 to grip tubular string 10 with greater axial force. To release tubular string 10, its weight is removed from slip jaws 32 and slip jaws 32 are pulled from contact with tubular string 10 (i.e. "released") as seen in fixed slip assembly 6 shown in FIG. 1. All of the foregoing related to setting and releasing slips is well known in the art.

As is also known in the art, it is desirable to automate the releasing and setting of slips. This may be accomplished by attaching slip linkage 34 to jaws 32 and having slip linkage 34 raised and lowered by hydraulic set/release piston and cylinders 35 ("set/release cylinders 35"). FIG. 1 illustrates fixed slip assembly 6 having the pistons of set/release cylinders 35 in the raised or released position. Rotating slip assembly 5 is shown with the pistons of set/release cylinders 35 in the lowered or set position. It will be understood that hydraulic fluid (or alternatively compressed air) is selectively supplied to set/release cylinders 35 in order to raise and lower the pistons therein. Hydraulically activated slip assemblies such as just described are commercially available from companies such as Calvins Oil Well Tools located at 2853 Cherry Avenue, Long Beach, Calif. 90806 and Hydro-Rig located at 600 E. Berry, Fort Worth, Tex. 76119.

As best seen in FIG. 2, the rotating slip assembly 5 will generally comprise slip bowl 30 (and the other components constituting the slips) being fixed to a swivel platform 39. In the embodiment shown, the swivel platform 39 will include a swivel base 40 and a rotating hub 42. Swivel base 40 is an annular structure resting upon mounting plate 21. Support legs 16 pass through swivel base 40 and it will be understood that swivel base 40 is fixed with respect to mounting plate 21 and support legs 16. Another annular structure, hub track 41, is fixed within swivel base 40. Hub track 41 will include a rail 45 extending inward therefrom which will be explained below. Rotating hub 42 is further positioned within swivel base 40. Rotating hub 42 is also an annular structure and has a tubular pathway 55 formed through its center. Tubular pathway 55 will have a diameter sufficiently large to allow not only tubulars to pass therethrough, but also any tools connected in tubular string 10. Rotating hub 42 further includes a shoulder 47 which will be supported on the rail 45 extending inward from hub track 41. FIG. 2 illustrates how bearings 43 will be positioned between shoulder 47 and rail 45. It will be readily apparent that bearings 43 allows rotating hub 42 to freely rotate upon rail 45 and relative to swivel base 40. "Freely rotate" as used herein means that rotating hub 42 may rotate with the rotation only being inhibited by the friction inherent in the bearings 43, seals 52 (explained blow) and the like.

In order to transfer hydraulic fluid to slip set/release cylinders 35, a hydraulic swivel assembly 46 will be attached to swivel base 40. Hydraulic swivel assemblies are well known in the art and one such hydraulic swivel assembly is utilized in a rotary table available from Superior Manufacturing, Inc., located at 4225 Hwy. 90 East, Broussard, La. Hydraulic swivel assembly 46 allows a fixed hydraulic fluid line 48 to transfer fluid through the rotating hub 42. Swivel assembly 46 includes a hydraulic swivel ring 53 which encircles rotating hub 42, but is held stationary to swivel base 40. An aperture 58 is formed through swivel ring 53 at the point fluid transfer line 48 engages swivel ring 53. As part of hydraulic swivel assembly 46, rotating hub 42 will have two annular passages 50 and 51 formed there through. It should be understood that passages 50 and 51 are annular in the sense that they form a space completely encircling the interior circumference of rotating hub 42. Because passage 50 is annular, passage 50 may remain in fluid communication with fluid line 48 throughout rotating hub 42's entire range of rotation. While not explicitly shown in FIG. 2, it will be understood that annular passage 52 communicates with hydraulic line 49 in the same manner. Seals 52 will insure fluid does not escape from the point where swivel ring 53 mates with rotating hub 42. Passage 50 will cease being annular as it becomes line 54 exiting rotating hub 42. Line 54 will in turn be connected to set release cylinder 35. While line 54 is only shown connected to one set/release cylinder 35, it will be understood that line 54 will communicate with all set/release cylinders 35.

Because fluid entering line 48 will eventually flow into cylinder 35 at a point below the piston head in cylinder 35, line 48 forms the slip release line. While not shown in the Figures, annular passage 51 will communicate with cylinders 35 at a point above the piston head in order to set the slips. It will be understood that since annular passage 51 directs fluid from hydraulic line 49 to a point above the piston head, hydraulic line 49 forms the slip set line. The insert of swivel assembly 46 seen in FIG. 1 illustrates how these two annular passages 50 and 51 could alternatively be formed side by side in rotating hub 42. The insert drawing of swivel assembly 46 differs from that seen in FIG. 2 because release line 48 and set line 49 are shown on the same side. FIG. 2, of course, shows release line 48 and set line 49 appearing on opposite sides of rotary hub 42. Nevertheless, the concept of how the two annular passageways 50 and 51 may be formed in rotating hub 42 will be readily apparent to those skilled in the art. It will be noted that the rotary table available from Superior Manufacturing, Inc., has many features similar to swivel platform 39, including a rotating hub, a hydraulic swivel assembly, and connections for hydraulically activated slips. The key difference between the rotary table produced by Superior Manufacturing, Inc. and swivel platform 39 is that the rotary table is driven by motors rather than being "freely rotating" as described above. In other words, to rotate the Superior Manufacturing, Inc. rotary table, the inertia of the motors must be overcome before the table will rotate. Thus, the rotary table is not freely rotating. However, a person of ordinary skill in the art could rapidly convert the Superior Manufacturing, Inc. rotary table into a swivel platform 39 as described herein by removing the motors and any gearing which obstructed free rotation.

There are many instances in snubbing operations where is it desirable to rotate the tubular string. For example, it may be desirable to place a milling tool to tubular string 10 and mill through a plug or some type of packing in the well bore. Alternatively, circumstances may arise where it is desirable to place a drill bit on tubular string 10 and conduct light drilling operations. Naturally, both of these functions require rotation of tubular string 10. Snubbing unit 1 of the present invention allows such rotation in a more efficient and safer manner than hereto known in the art. To rotate tubular string 10, fixed slip assembly 6 will be released while tubular string 10 is held in position vertically by rotating slip assembly 5. Back-up tong 3 releases tubular string 10 while power tong 2 grips tubular string 10 and applies torque thereto. As discussed above, legs 16 prevent power tong 2 from rotating with respect to mounting plate 21 (and thus with respect to the entire snubbing unit 1). However, since rotating slip assembly 5 may freely rotate on mounting plate 21, rotating slip assembly 5 readily rotates with tubular string 10. The only resistance to tubular string 10's rotation by slip assembly 5 will be that caused by frictional forces in the bearings or seals. Thus, power tong 2 may provide sufficient torque to tubular string 10 for drilling or milling operations.

Those skilled in the art will immediately see the advantages of snubbing unit 1. The snubbing unit 1 grips tubular string 10 with power tong 2 which is a tool specifically design to apply high torque loads to a tubular member. This is a far more secure manner of gripping a tubular member when applying torque than gripping with conventional slip jaws. Thus, the damaging scarring to the tubular surface will be dramatically reduced. Additionally, snubbing unit 1 allows power tong 2 not only to make-up and break apart tubular joints, but also allows power tong 2 to provide the torque source for drilling or milling purposes. Thus, the powered rotary table required in prior art snubbing units is not needed. Finally, snubbing unit 1 provides a manner of rotating tubular string 10 without having to rotate power tong 2 and back-up tong 3. This means the workers in basket 4 are not exposed to dangerous rotating equipment. All of these advantages render snubbing unit 10 a significant improvement in the art.

Figure 3:
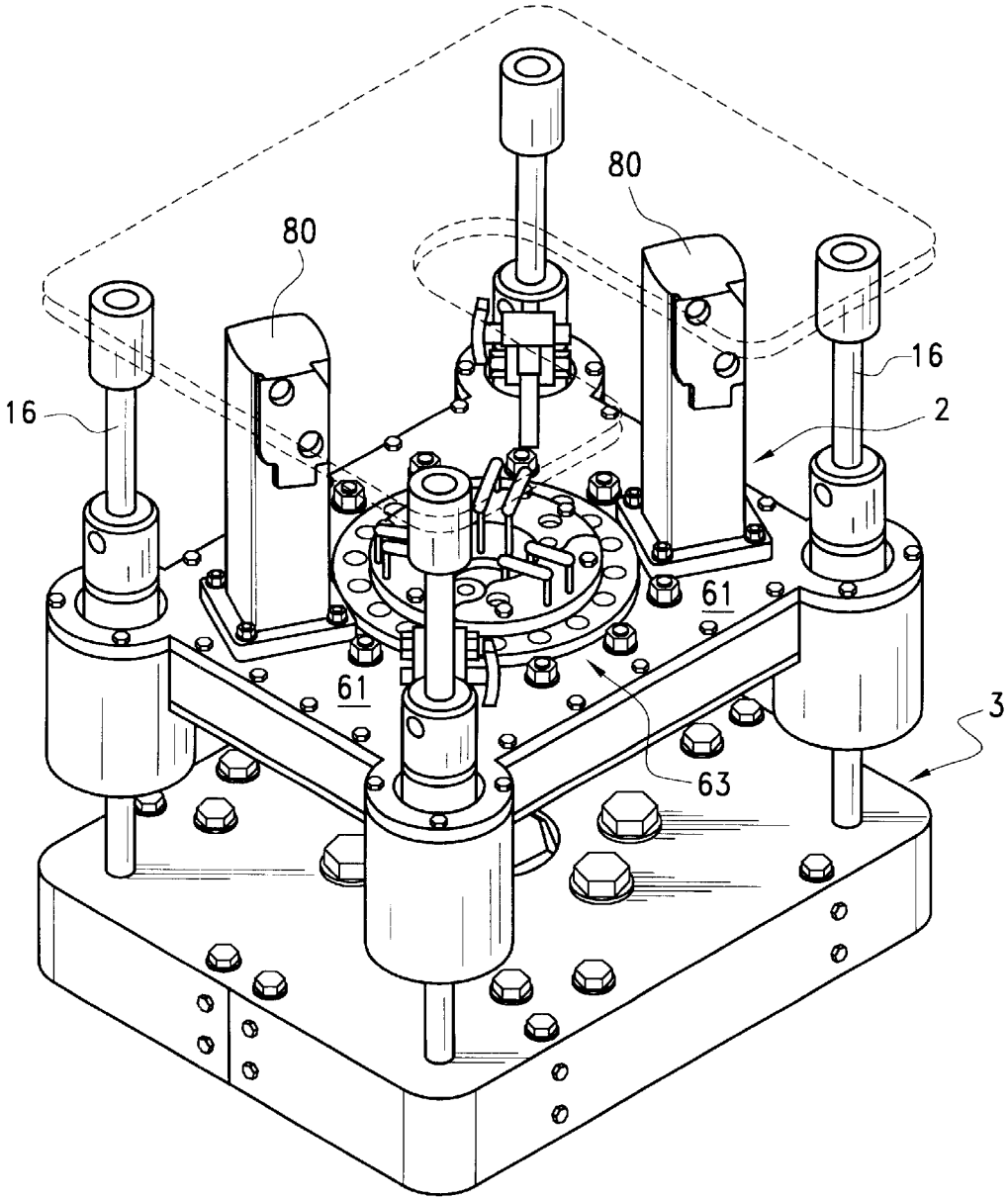
FIG. 3 is a perspective view of a power tong suitable for use with the present invention.
Figure 4:
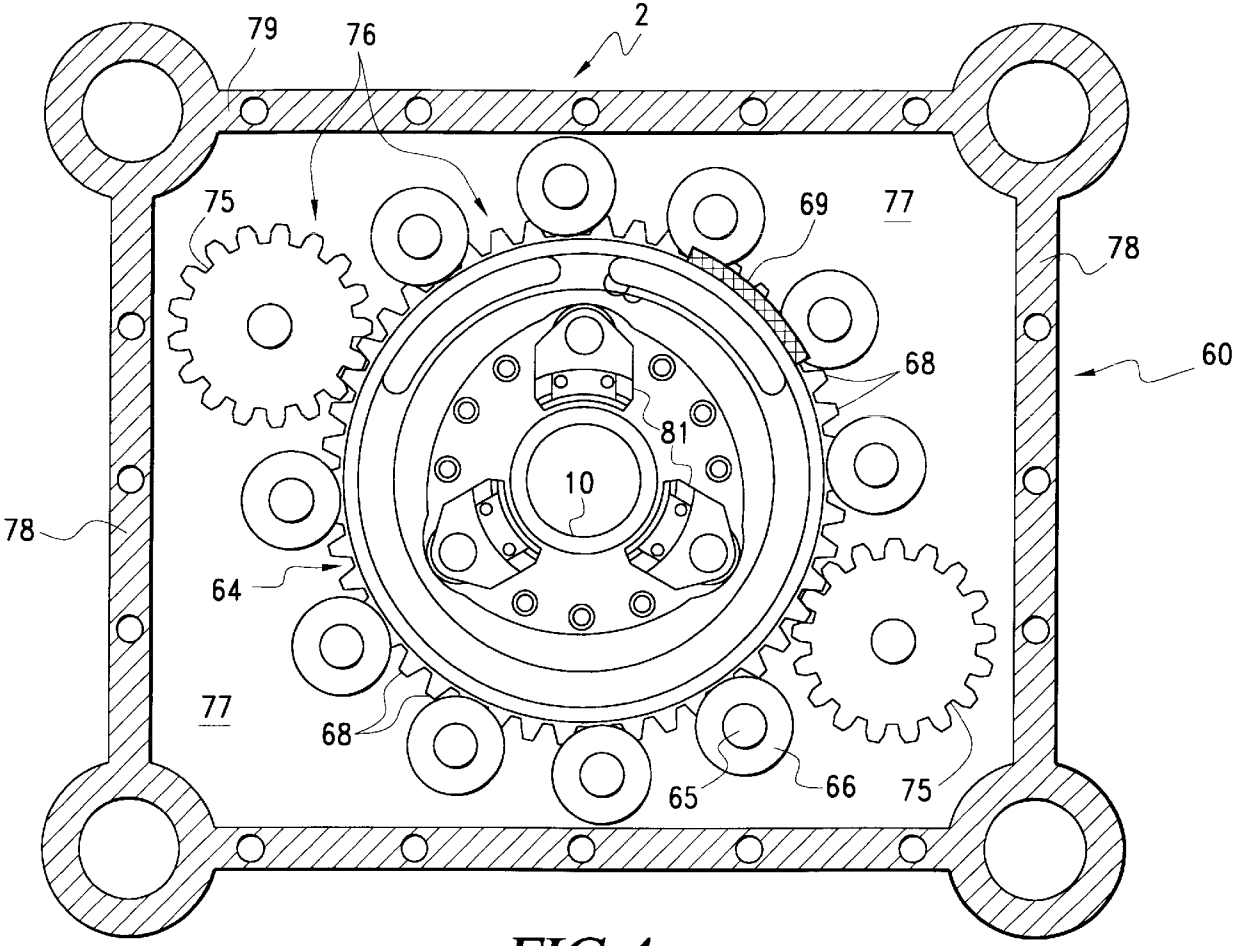
FIG. 4 is a top view of the power tong in FIG. 3, but having the top plate and top cage plate removed.
Figure 5:
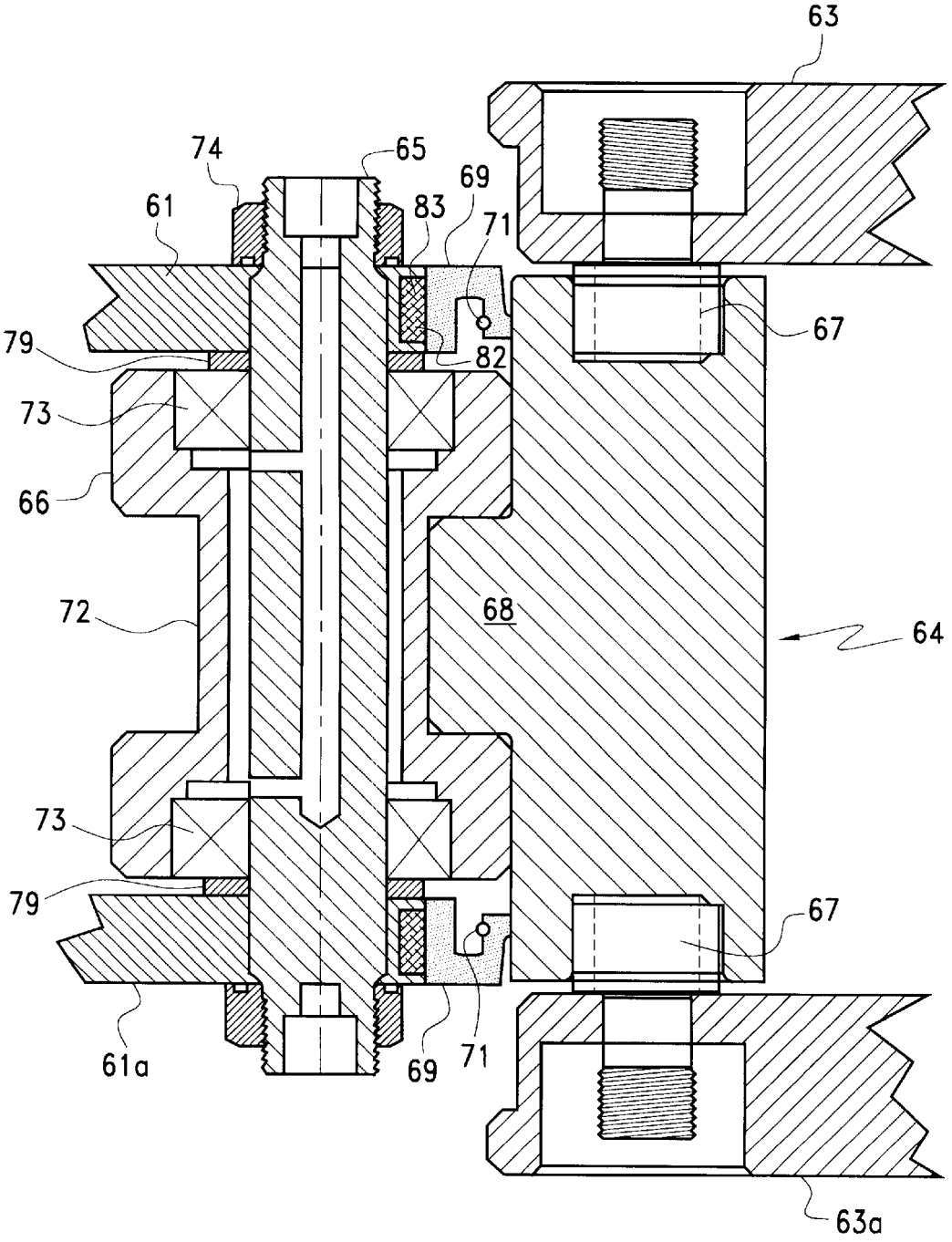
FIG. 5 is a partial sectional view of the power tong seen in FIGS. 3 and 4.

While the power tong 2 used to rotate tubular string 10 could be any type of power tong commonly used in the drilling industry to makeup or break apart tubular connections, closed head power tongs such as disclosed in U.S. patent application Ser. No. 09/349,292 are more typically used on snubbing units. FIG. 3 illustrates a power tong 2 (and back-up tong 3) such as disclosed in application Ser. No. 09/349,292. FIG. 3 shows, among other features of power tong 2, the power tong's top cage plate 63, top plate 61 and drive motors 80. While not explicitly needed for disclosing the present invention, FIG. 5 shows tong 2 will include bottom cage plate 63*a* and bottom plate 61*a*. FIG. 4 illustrates power tong 2 with top plate 61 and cage plate 63 removed. Power tong 2 will have a body 60 with an interior 77. Positioned within interior 77 will be a gear train 76 which comprises drive gears 75 and ring gear 64. As is known in the art, motors 80 will apply torque to drive gears 75 which in turn provide torque to ring gear 64 by engaging the teeth 68 of ring gear 64. As is known in the art, gear train 76 could include various other gears, such as reduction gears, but these have been excluded for simplicity. The manner in which ring gear 64 rotates and causes jaws 81 to grip tubular string 10 is not part of the present invention, but is explained in application Ser. No. 09/349,292. FIG. 5 is a partial cross-sectional view of ring gear 64 and its related structure. FIG. 5 shows how ring gear 64 is supported by its teeth 68 resting in mid-section 72 of dumbell rollers 66. Dumbell rollers 66 are mounted on shafts 65 and include bearings 73 which allow dumbell rollers 66 to rotate freely with respect to shafts 65. Thus, dumbell rollers 66 allow ring gear 64 to rotate when driven by drive gears 75. While the above described gear train 76 is known in the art, in a preferred embodiment of the present invention, power tong 2 will have a further novel feature. In most prior art power tongs, the gear train is positioned within the tong body, but not generally sealed within the body. The gear train is lubricated with conventional grease and this lubrication is not circulated through the gear train. This lubrication system is satisfactory when the power tong use is intermittent, such as when making up and breaking apart tubular joints. However, using the power tong to rotate the tubular string in a drilling capacity will subject the power tong to much longer periods of sustained operation. Such sustained operation may generate excessive heat in the gear train. In order to reduce the heat generated in the gear train, a preferred power tong will incorporate an oil cooled lubrication system. The oil cooled lubrication system would surround the gears of gear train 76 in an oil bath. The oil may be a conventional 90 weight gear oil (or other suitable oil) and will be sufficiently fluid to allow it to flow around the gear trains components and draw heat from those components. To retain the oil within the tong body interior 77, various seals, typically low pressure seals, are position in power tong 2. First, around the entire perimeter 78 (see FIG. 4) of tong body 60, a seal 79 (only a section of which is shown) will provide a substantially fluid tight seal between perimeter 78 and top plate 61. Second, rotary seal 69 will provide a seal around ring gear 64. Only a portion of rotary seal 69 is shown in FIG. 4, but it will be understood that rotary seal 69 extends around the entire circumference of ring gear 64. Such a rotary seal is available from Garlock, Incorporated located at 700 Mid-Atlantic Parkway, Thorofare, N.J., 08086. FIG. 5 illustrates in more detail how rotary seal 69 will be attached on one side to top plate 61 by way of the seal's rigid section 82 being pressed in a groove 83 formed in the edge of top plate 61. A more flexible rubber section of seal 69 will be held against ring gear 64 by a spring steel retainer ring 71. The another seal 69 will be positioned between bottom plate 61*a* and bottom cage plate 63*a*. Naturally, ring gear 64 will be able to rotate as intended while seal 69 prevents cooling oil from escaping tong interior 77. It will be understood there will be other conventional seals where components must penetrate to the interior 77 of tong body 60. However, it will be readily apparent to those skill in the art how to construct and employ any other necessary seals. Viewing FIG. 4, it can be seen how seals 79 and 69 contain oil within interior 77 and allow the formation of an oil bath for the gear train components. In particular, rotary seal 69 is important in preventing the leakage of oil from interior 77 to the open areas in the tong center such as the center opening through which tubular 10 is inserted. As previously described, the oil bath would be non-circulating. However, in situations where there is heavy and sustained power tong use, it may be advantageous to provide a circulating system for the oil bath in order to achieve extra cooling capacity. The oil in interior 77 could be pumped from interior 77 and passed through an oil cooler before being returned to interior 77. Oil cooling and circulating systems are well known in the art and any such suitable system could be employed with the present invention. In reference to back-up tong 3, a preferred embodiment of back-up tong 3 will be a hydraulically activated back-up tong. Hydraulically activated back-up tongs utilize hydraulic fluid flowing into the back-up tong to cause the tong jaws to close and grip the tubular. One example of such a hydraulically activated back-up tong is seen in U.S. Pat. No. 5,702,139 to David Buck, the entirety of which is incorporated by reference herein.

The snubbing unit 1 may be modified in various ways and still fall within the scope of the present invention. For example, a stop device such as pin 37 is shown schematically in FIG. 2. Pin 37 may be inserted into an aperture formed through swivel base 40, hub track 41, and rotating hub 42. The function of pin 37 is to prevent rotation of rotary hub 42 if such action becomes necessary during snubbing operations. For example, if back-up tong 3 malfunctioned or was not otherwise available, pin 37 could be inserted to immobilize rotating hub 42. With slip assembly 5 gripping a tubular below the tubular joint 12 as seen in FIG. 1, power tong 2 may apply torque above tubular joint 12 to make-up or break apart the tubulars. While such use of slip assembly 5 would probably only take place in unusual circumstances, it illustrates the versatility of the present invention. It also a well known in the art that snubbing units may be employed to force tubulars into a pressurized well. In such a situation, the gripping direction of at least one slip assembly is reversed as illustrated in U.S. Pat. No. 5,746,276 to Stuart which is incorporated by reference herein. Either or both of fixed slip assembly 6 or rotating slip assembly 5 may be modified by any method known in the art to reverse the gripping direction of the slips.

While the power tong, back-up tong combination has been shown in the Figures as being rigidly fixed by support legs to a mounting plate, it will be understood that there could be many acceptable methods of attaching the power tong, back-up tong combination to the snubbing unit. The important feature is that the power tong be secured such that it may not rotate in conjunction with the freely rotating slip assembly. Thus, it would be within the general scope of the method and apparatus disclosed herein if the power tong and/or back-up tong was rotatingly coupled to the snubbing unit, but was nevertheless fixed by an external means. Such an external fixing means could be a cable connected between the power tong (or back-up tong) and some fixed part of the snubbing unit or other structure. Thus, if the power tong was used to transfer torque to a tubular string, the cable would hold the power tong itself against rotation. It is believed that those skilled in the art will recognize many other embodiments which fall within in the scope of the present invention. These embodiments and all other equivalent variations and modifications of the present invention are intended to come within the scope of the following claims.

We claim:

1. A snubbing unit drilling system comprising:

a. a power tong;

b. a hydraulically activated back-up tong;

c. a mounting structure having a rotating slip assembly positioned thereon, including a circular track and a hub rotatingly mounted on said track; and d. a plurality of support legs attached between said power tong, said back-up tong, and said mounting structure such that said support legs prevent relative rotation between said power tong and said mounting structure.

2. The system according to claim 1, wherein said slip assembly rotates freely relative to said mounting structure.

3. The system according to claim 1, wherein said mounting structure is a mounting plate.

4. The system according to claim 1, wherein a slip bowl is positioned on said hub.

5. The system according to claim 4, wherein said slip bowl includes an automated slip release mechanism.

6. The system according to claim 5, wherein said automated slip release mechanism comprises a hydraulic piston in said slip bowl and a linking member connected to a slip jaw.

7. The system according to claim 5, wherein said automated slip release mechanism includes a hydraulic fluid path communicating through said hub.

8. The system according to claim 7, wherein said hydraulic fluid path forms a hydraulic swivel.

9. The system according to claim 1, wherein a lift assembly is effectively connected to said mounting structure.

10. The system according to claim 9, wherein said lift assembly is positioned upon a snubbing unit base plate and a second slip assembly is positioned on said base plate.

11. The system according to claim 10, wherein said second slip assembly is fixed against rotation upon said base plate.

12. The system according to claim 10, wherein said lift assembly comprises a plurality of hydraulic cylinders.

13. The system according to claim 9, wherein said lift assembly comprises a plurality of hydraulic cylinders.

14. The system according to claim 1, wherein said power tong has an enclosed gear train positioned in an oil bath.

15. The system according to claim 14, wherein said enclosed gear train includes a ring gear and a rotary seal positioned around said ring gear.

16. A method of rotating a tubular string comprising the steps of;

a. supporting a tubular string in a freely rotating slip assembly which includes a circular track and a hub rotatingly mounted on said track;

b. fixing a power tong and a hydraulically activated back-up tong in line with said tubular string; and c. gripping said tubular string with said power tong and applying torque to said tubular string with said power tong.

17. The method of claim 16, further comprising the step of providing a hydraulic set/release mechanism to set or release the slips of said rotating slip assembly.

18. The method of claim 16, further comprising the step of providing a hydraulic lift assembly for elevating said rotating slip assembly.

19. The method of claim 16, further comprising the step of providing a fixed slip assembly positioned inline with said tubular string.

20. A snubbing unit drilling system comprising:

a. a power tong wherein said power tong has an enclosed gear train positioned in an oil bath;

b. a mounting structure having a rotating slip assembly positioned thereon such that said rotating slip assembly may rotate relative to said mounting structure; and c. a support attached to said power tong, such that said power tong is prevented from rotating relative to said rotating slip assembly.

21. The system according to claim 20, wherein said support further comprises a plurality of support legs.

22. The system according to claim 20, wherein said enclosed gear train includes a ring gear and a rotary seal positioned around said ring gear.

23. The system according to claim 20, further including a hydraulically activated back-up tong.

24. A snubbing unit drilling system comprising:

a. a power tong;

b. a hydraulically activated back-up tong;

c. a mounting structure having a rotating slip assembly positioned thereon including a circular track and a hub rotatingly mounted on said track; and d. a support attached to one of either said power tong or said back-up tong, such that said power tong is prevented from rotating relative to said rotating slip assembly.

25. A snubbing unit drilling system comprising:

a. a power tong having a gear train, wherein at least a portion of said gear train is enclosed and positioned in an oil bath;

b. a back-up tong;

c. a mounting structure having a rotating slip assembly positioned thereon such that said rotating slip assembly may rotate relative to said mounting structure; and d. a support attached to one of either said power tong or said back-up tong, such that said power tong is prevented from rotating relative to said rotating slip assembly.

* * * * *